US009625174B2

(12) United States Patent
Koop

(10) Patent No.: US 9,625,174 B2
(45) Date of Patent: Apr. 18, 2017

(54) AIR CONTROL DAMPER WITH RETRACTING END BLADE STOP

(71) Applicant: RUSKIN COMPANY, Grandview, MO (US)

(72) Inventor: Edward N. Koop, Olathe, KS (US)

(73) Assignee: RUSKIN COMPANY, Grandview, MO (US)

( * ) Notice: Subject to any disclaimer, the term of this patent is extended or adjusted under 35 U.S.C. 154(b) by 496 days.

(21) Appl. No.: 14/225,303

(22) Filed: Mar. 25, 2014

(65) Prior Publication Data

US 2015/0276258 A1 Oct. 1, 2015

(51) Int. Cl.

| | |
|---|---|
| ***F24F 7/00*** | (2006.01) |
| ***F24F 13/06*** | (2006.01) |
| ***F24F 13/14*** | (2006.01) |
| ***F24F 13/15*** | (2006.01) |

(52) U.S. Cl.

CPC ..... *F24F 13/1413* (2013.01); *F24F 13/1426* (2013.01); *F24F 13/15* (2013.01); *Y10T 29/49826* (2015.01)

(58) Field of Classification Search

CPC ..... F24F 13/1413; F24F 13/1426; F24F 13/15
USPC ..... 454/319
See application file for complete search history.

(56) References Cited

U.S. PATENT DOCUMENTS 3,204,548 A * 9/1965 McCabe ..... F24F 13/15 454/352
3,275,031 A * 9/1966 Alyea ..... F24F 13/15 137/601.06
3,281,113 A * 10/1966 Ahern ..... F16K 1/165 137/601.08
3,303,772 A * 2/1967 Wheatley ..... F24F 11/04 236/49.5
3,464,341 A * 9/1969 Dobrin ..... F24F 13/1413 454/336
3,746,042 A * 7/1973 Finkel ..... F24F 13/14 137/601.06
3,771,559 A * 11/1973 Alley ..... F16K 1/165 137/601.06
3,783,768 A * 1/1974 Caming ..... F24F 13/15 454/335
3,832,940 A * 9/1974 Hess ..... A62C 2/06 137/601.06
4,077,432 A * 3/1978 Herr ..... F16K 1/165 137/246.22
5,020,423 A * 6/1991 Hill ..... F24F 13/1426 454/319
5,238,453 A * 8/1993 Heil ..... F24F 13/15 137/601.09
5,425,673 A * 6/1995 Mahlanen ..... A62C 2/14 137/601.09

(Continued)

*Primary Examiner* — Steven B McAllister
*Assistant Examiner* — Jonathan Cotov
(74) *Attorney, Agent, or Firm* — Jackson Walker LLP; Christopher J. Rouk

(57) ABSTRACT

An air control damper, comprising a shaft coupled to a frame. A first full blade coupled to the axel and disposed within the frame. A rocker assembly coupled to the first full blade. A first rod coupled to the rocker assembly. A cross-link assembly coupled to the first rod. A half blade coupled to the cross-link assembly and disposed on a first shaft within the frame, wherein the half blade is configured to provide a blade stop for the first full blade in a closed position.

19 Claims, 9 Drawing Sheets

(56) References Cited

U.S. PATENT DOCUMENTS

| | | | | | |
|---|---|---|---|---|---|
| 5,580,307 | A * | 12/1996 | Arosio | A62C 2/14 | 137/601.09 |
| 5,674,125 | A * | 10/1997 | Xia | F16K 1/223 | 454/327 |
| 5,810,662 | A * | 9/1998 | Van Becelaere | A62C 2/14 | 454/284 |
| 6,019,679 | A * | 2/2000 | Lloyd | A62C 2/14 | 251/314 |
| 6,181,557 | B1 * | 1/2001 | Gatti | H05K 7/20618 | 165/122 |
| 8,550,888 | B2 * | 10/2013 | Hildreth, Jr. | F16K 1/165 | 251/212 |
| 9,395,098 | B2 * | 7/2016 | Enke | F24F 13/14 | |
| 2009/0253367 | A1 * | 10/2009 | Kupferberg | F24F 13/1406 | 454/358 |

* cited by examiner

AIR CONTROL DAMPER WITH RETRACTING END BLADE STOP

TECHNICAL FIELD

The present disclosure relates generally to heating, ventilation and air conditioning equipment, and more specifically to an air control damper with a retracting end blade stop.

BACKGROUND OF THE INVENTION

Air control dampers typically have stops that cause at least a portion of the air control damper to extend outward, which creates drag and leakage.

SUMMARY OF THE INVENTION

An air control damper is provided that includes an axel connected to a frame, such as by inserting the axel through a first bushing or opening in a first side of the frame. A first full blade is coupled to the axel and is disposed within the frame, such as by extending the axel through the first full blade and inserting the axel through a second bushing or opening in a second side of the frame. A rocker assembly is coupled to the first full blade, such as by a rotatable connector. A first rod is coupled to the rocker assembly, and a cross-link assembly is also coupled to the first rod. A half blade is coupled to the cross-link assembly and disposed on a first shaft within the frame, wherein the half blade is configured to provide a blade stop for the first full blade in a closed position, such as by rotating about the shaft when a torque is applied to the second rocker assembly through the first rod.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1A:
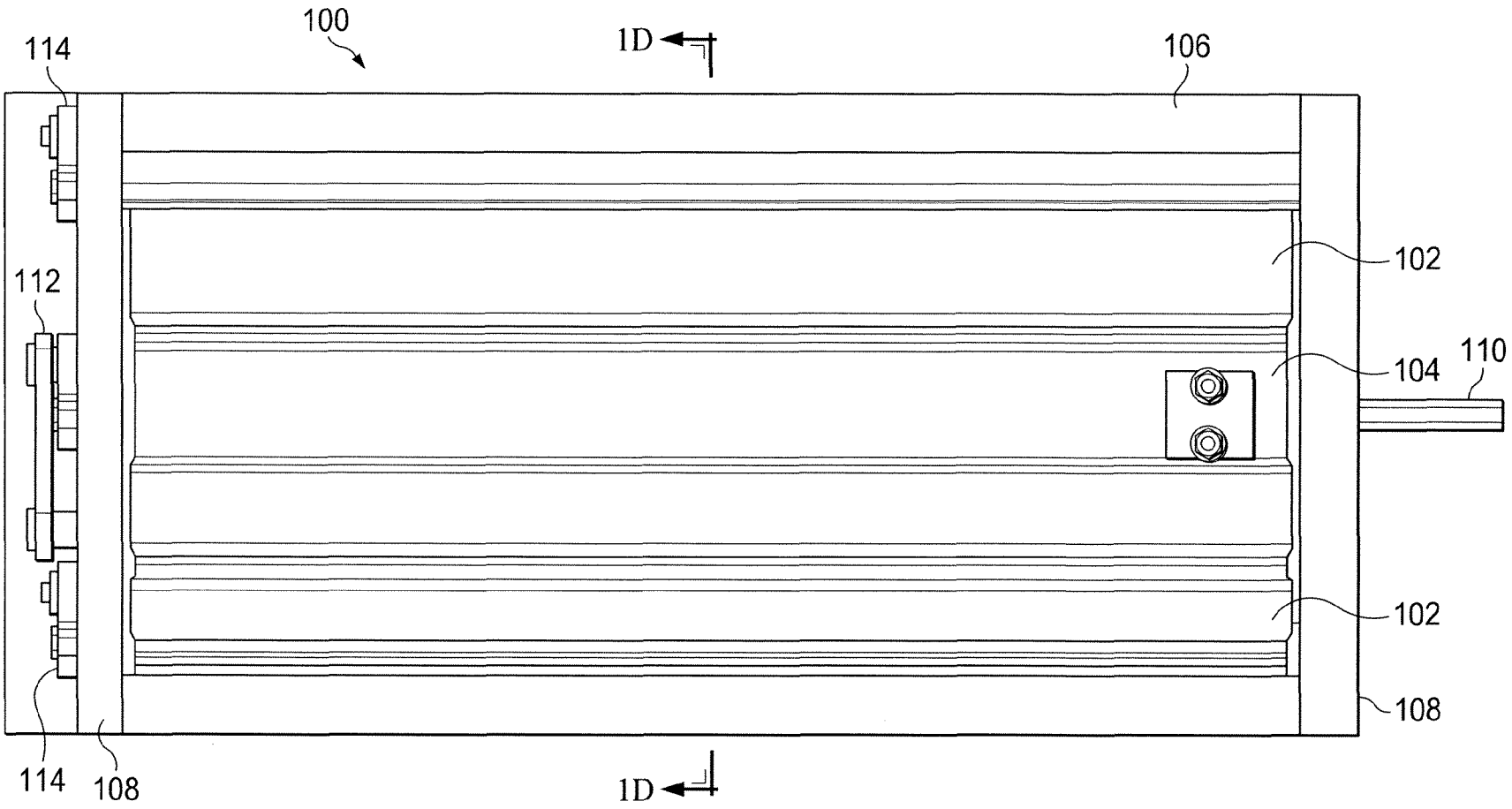
FIG. 1A is a diagram of an air control damper in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1A is a diagram of an opposed blade air control damper 100 in accordance with an exemplary embodiment of the present disclosure. Air control damper 100 can be formed from steel, aluminum or other suitable materials, by processes such as stamping, molding, machining or other suitable processes.

Air control damper 100 includes partial blades 102 and full blade 104, which are disposed within frame top and bottom 106 and frame sides 108, and which are shown interlocked in a closed position. Axel 110 extends through bushings or other suitable openings in each frame side 108 and is used to rotate partial blades 102 and full blade 104, in conjunction with cross-over link 112, which is used to effect opposed action, and rocker 114 and associated rods or other structures that are used to convey torque from axel 110 and full blade 104 to partial blades 102. Partial blades 102 and full blade 104 are each mounted on a shaft (not shown) that is disposed within the frame, such as by extending the shaft through a bushing or other suitable opening in each frame side 108. Cross-over links 112 and rocker 114 are used to control opposed blade motion, where full blade 104 opens in a first direction, such as clockwise, and immediately adjacent partial blades 102 and full blade 104 opens in the opposite direction, such as counter clockwise. In another exemplary embodiment, rockers 114 can be used without cross-over links 112, when all blades move in parallel and open in the same direction, such as clockwise or counter-clockwise.

In operation, air control damper 100 uses partial blades 102 as blade stops, which allows the partial blades 102 to be rotated when air control damper 100 is in the open position so as to reduce the cross sectional area that blocks air flow, instead of requiring a blade stop that remains fully extended into the air flow path. In this manner, air control damper 100 provides increased efficiency by reducing the amount of air flow resistance that is seen in the air flow path when air control damper 100 is fully open.

Figure 1B:
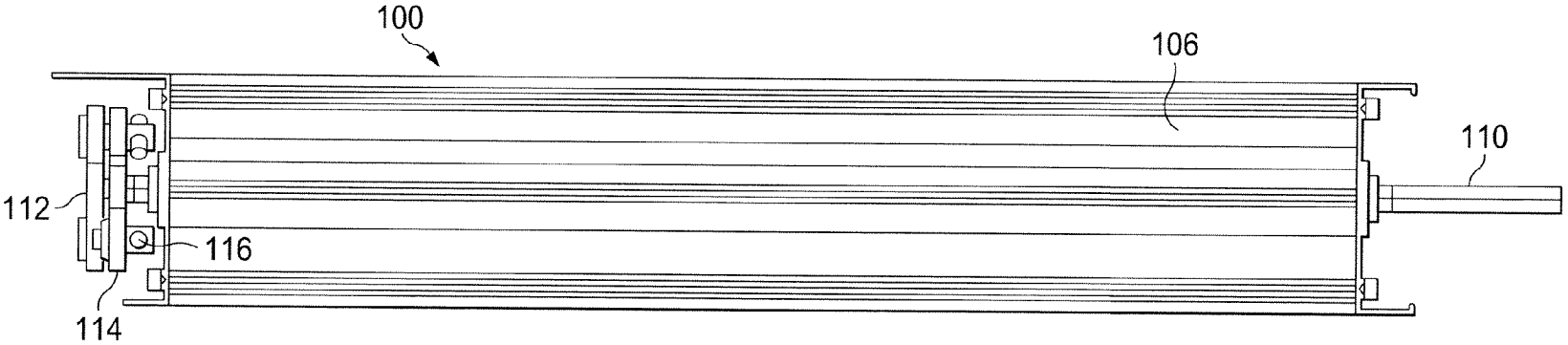
FIG. 1B is a top view of air control damper in accordance with an exemplary embodiment of the present disclosure.

FIG. 1B is a top view of air control damper 100 in accordance with an exemplary embodiment of the present disclosure. Frame top 106 is shown in the center, with axel 110 entering the frame at the right and cross-over links 112 and rocker 114 on the left, connected by rod 116, which is used to convey torque from axel 110 through full blade 104 and cross-over links 112 and rocker 114 to the partial blades 102.

Figure 1D:
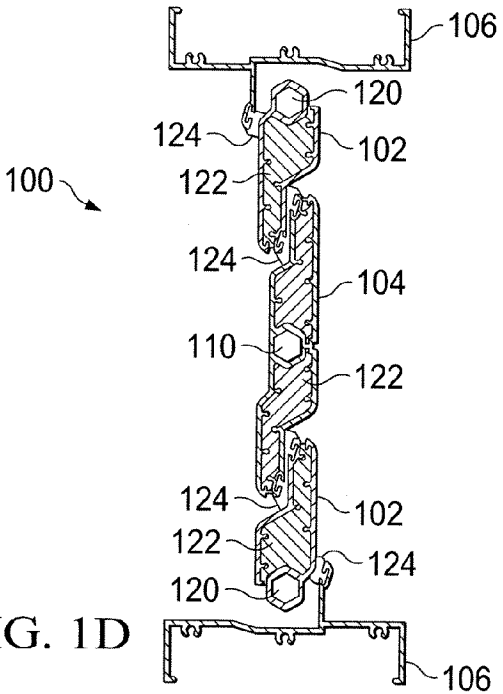
FIG. 1D is a section view of air control damper along cut line 1D of FIG. 1A in accordance with an exemplary embodiment of the present disclosure.
Figure 1C:
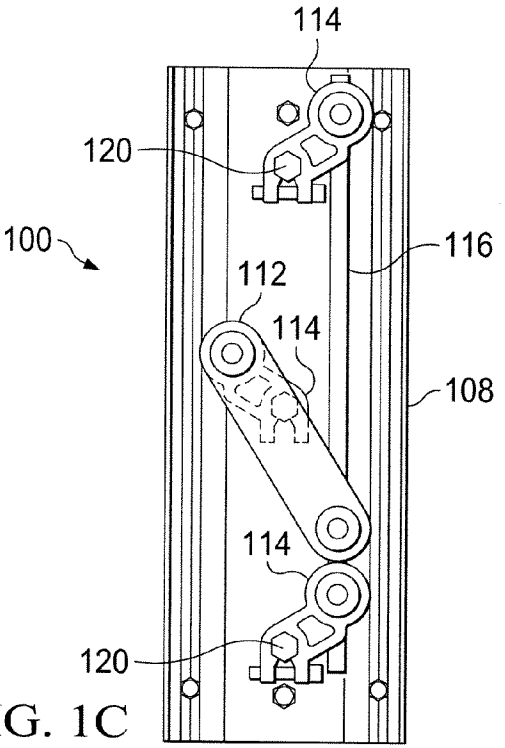
FIG. 1C is a side view of air control damper in accordance with an exemplary embodiment of the present disclosure.

FIG. 1C is a side view of air control damper 100 in accordance with an exemplary embodiment of the present disclosure. Rod 116 is coupled to cross-over links 112 and rocker 114, as shown, and causes cross-over links 112 and rocker 114 to move in a coordinated manner. Rockers 114 are coupled to shafts 120, which can extend through bushings or other suitable openings in frame side 108 and which are also coupled to partial blades 102, and which cause partial blades 102 to rotate when torque is applied. Shafts 120 can be a single component that extends entirely through partial blade 102, or can be segmented such that a first shaft portion is provided on one side of a partial blade 102 and a second shaft portion is provided on the opposite side of the same partial blade 102.

FIG. 1D is a section view of air control damper 100 along cut line 1D of FIG. 1A in accordance with an exemplary embodiment of the present disclosure. Partial blades 102 and full blades 104 are filled with insulation 122, which can be polymer foam or other suitable insulating materials. Partial blades 102 include shafts 120 and full blade 104 includes axel 110. Seals 124 are also shown inserted into slots of partial blades 102, full blades 104 and frame top and bottom 106. These seals provide addition protection from leakage when air control damper 100 is in a closed position.

Figure 2:
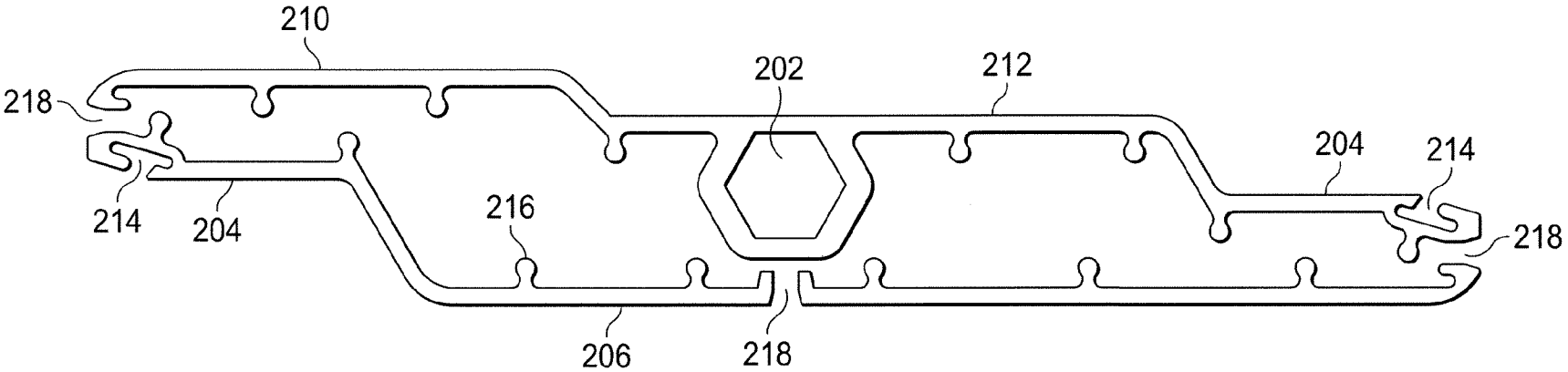
FIG. 2 is a diagram of full blade in accordance with an exemplary embodiment of the present disclosure.

FIG. 2 is a diagram of full blade 200 in accordance with an exemplary embodiment of the present disclosure. Full blade 200 includes slot 202, which is configured to allow axel 110 to be inserted to convey torque from a handle or mechanical operator to full blade 200, or to allow a shaft to be inserted to allow full blade 200 to rotate when full blade 200 is not used in a central driving position. End portions 204 are essentially equal in configuration, and include slots 214 for holding seals (not shown). A long side section 206 is disposed opposite of short side sections 210 and 212. The space between the long side section 206 and short side sections 210 and 212 can be filled with insulation, spacers and adhesive, or other suitable materials, and includes protrusions 216 that provide additional traction with such insulation, spacers or adhesive. Spaces 218 are cut-away areas to provide a thermal break to prevent energy loss from end portions 204 and long side section 206 to short side sections 210 and 212.

Figure 3:
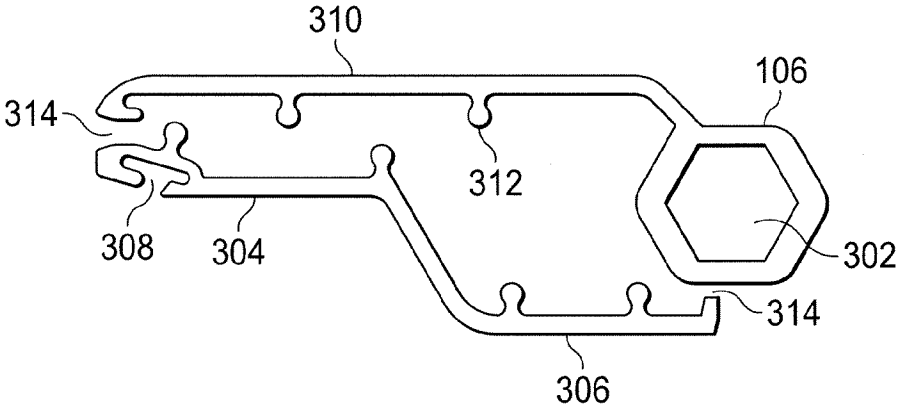
FIG. 3 is a diagram of half blade in accordance with an exemplary embodiment of the present disclosure.

FIG. 3 is a diagram of partial blade 300 in accordance with an exemplary embodiment of the present disclosure. Partial blade 300 includes slot 302, which is configured to allow a shaft to be inserted to allow half blade 300 to rotate. End portion 304 includes slots 308 for holding a seal (not shown). A long side section 310 is disposed opposite of short side sections 306 and end portion 304. The space between the long side section 310 and short side sections 306 and end portion 304 includes protrusions 316 and can be filled with insulation, spacers and adhesive, or other suitable materials. Gaps 314 are used to provide thermal breaks.

Figure 4:
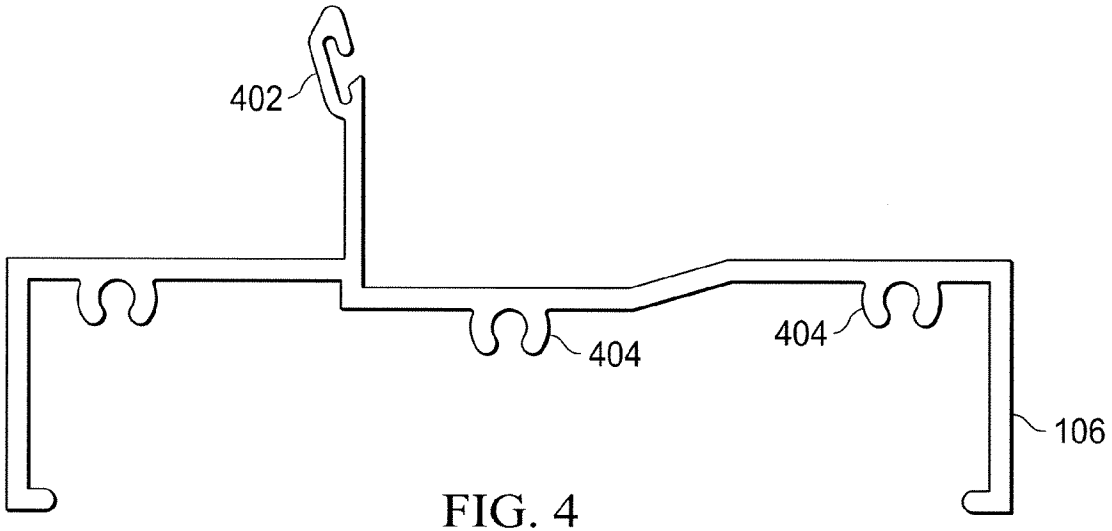
FIG. 4 is a detail diagram of a frame in accordance with an exemplary embodiment of the present disclosure.

FIG. 4 is a detail diagram of a frame 400 in accordance with an exemplary embodiment of the present disclosure. Frame 400 includes slot 402, which is configured to hold a seal, and slots 404, which are configured to hold fasteners to connect frame corners.

Figure 5:
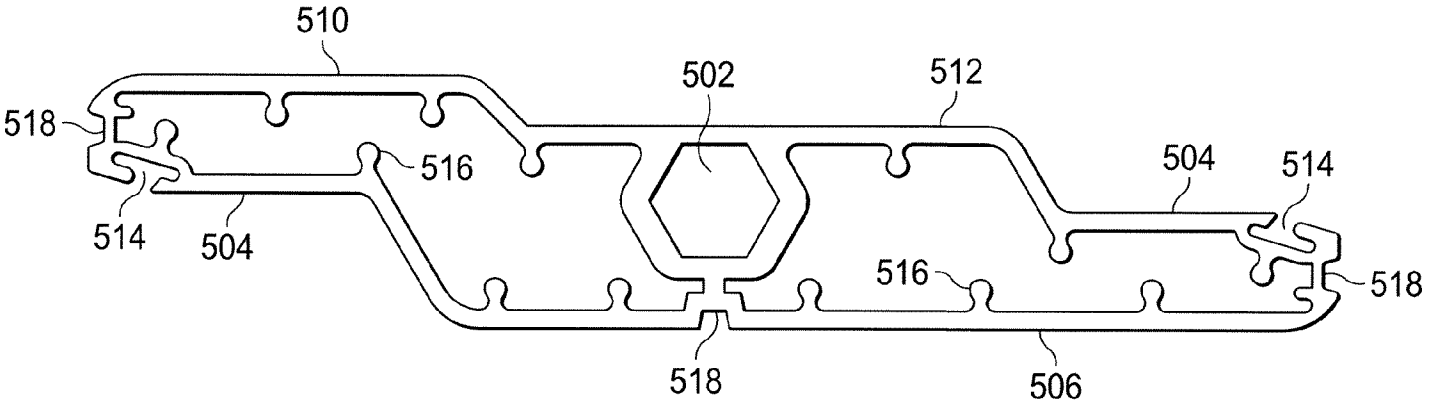
FIG. 5 is a diagram of an insulated full blade in accordance with an exemplary embodiment of the present disclosure.

FIG. 5 is a diagram of an insulated full blade 500 in accordance with an exemplary embodiment of the present disclosure. Insulated full blade 500 includes slot 502, which is configured to allow axel 110 to be inserted to convey torque from a handle or mechanical operator to full blade 500, or to allow a shaft to be inserted to allow insulated full blade 500 to rotate. End portions 504 are essentially equal in configuration, and include slots 514 for holding seals (not shown). A long side section 506 is disposed opposite of short side sections 510 and 512. The space between the long side section 506 and short side sections 510 and 512 can be filled with insulation, spacers and adhesive, or other suitable materials, and includes protrusions 516 that provide additional traction with such insulation, spacers or adhesive. End web 518 is cut away after application of insulation to provide a thermal break.

Figure 6A:
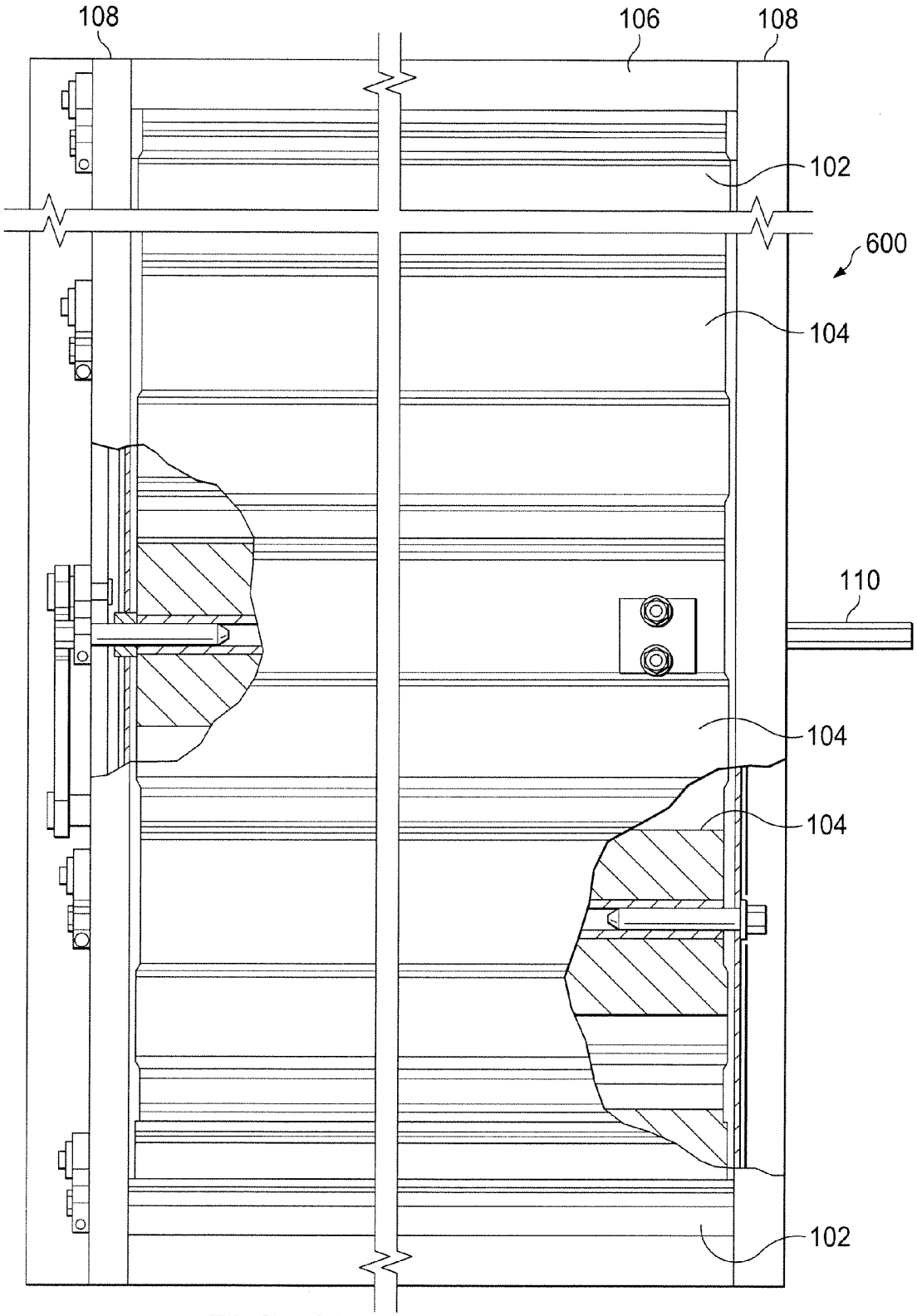
FIG. 6A is a diagram of multi-blade air control damper in accordance with an exemplary embodiment of the present disclosure.

FIG. 6A is a diagram of multi-blade air control damper 600 in accordance with an exemplary embodiment of the present disclosure. Air control damper 600 can be formed from steel, aluminum or other suitable materials, by processes such as stamping, molding, machining or other suitable processes.

Air control damper 600 includes partial blades 102 and full blades 104, which are disposed within frame top and bottom 106 and frame sides 108, and which are shown interlocked in a closed position. Axel 110 is used to rotate partial blades 102 and full blades 104, in conjunction with cross-over links 112 and rockers 114.

Figure 6B:
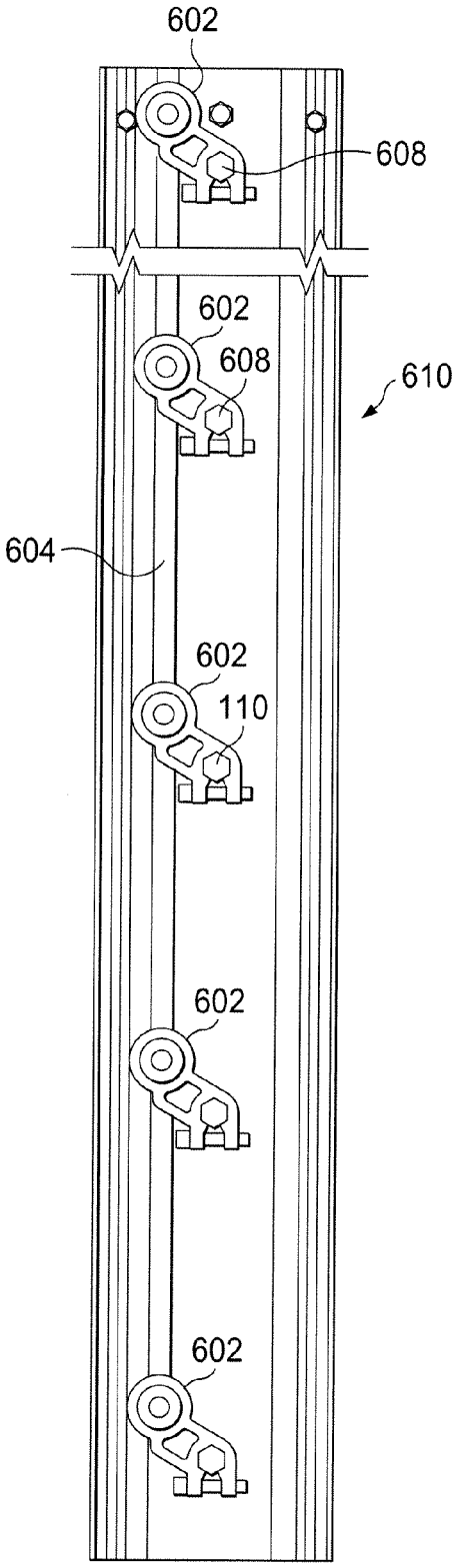
FIG. 6B is a diagram of parallel blade frame side in accordance with an exemplary embodiment of the present disclosure.

FIG. 6B is a diagram of parallel blade frame side 610 in accordance with an exemplary embodiment of the present disclosure. Rockers 602 are coupled to rod 604, which allows torque to be conveyed from axel 110 to shafts 608 when axel 110 is rotated.

Figure 6C:
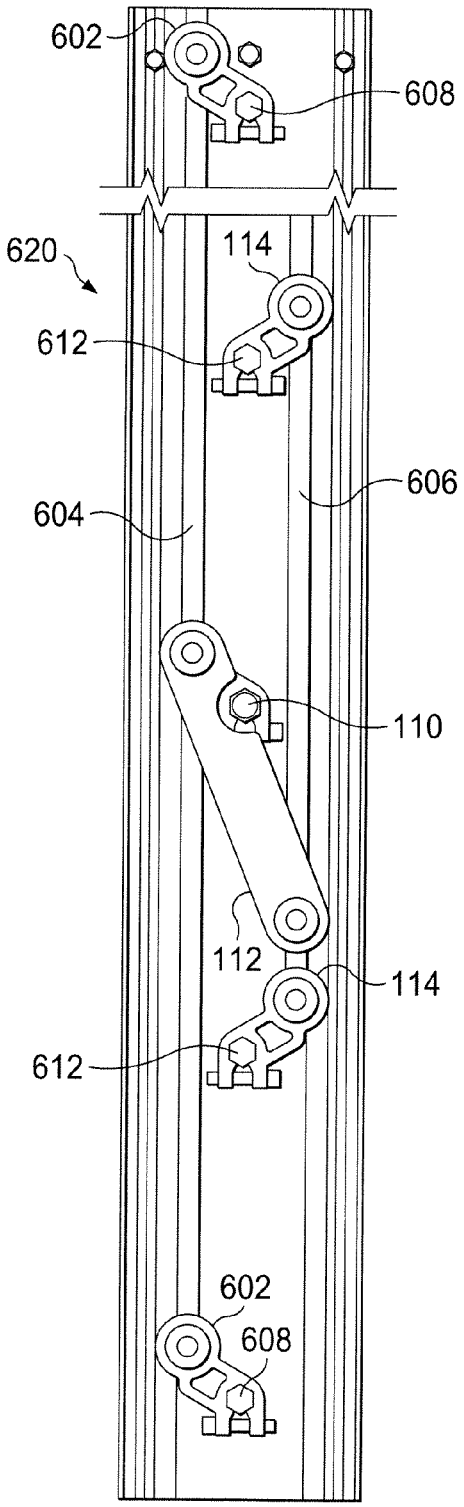
FIG. 6C is a diagram of opposed blade frame side in accordance with an exemplary embodiment of the present disclosure.

FIG. 6C is a diagram of opposed blade frame side 620 in accordance with an exemplary embodiment of the present disclosure. Rockers 602 are coupled to rod 604, which allows torque to be conveyed from axel 110 to shafts 608 when axel 110 is rotated. Cross-over links 112 and rockers 114 are coupled to rod 606, which allows torque to be conveyed from axel 110 to shafts 612 when axel 110 is rotated.

Figure 6D:
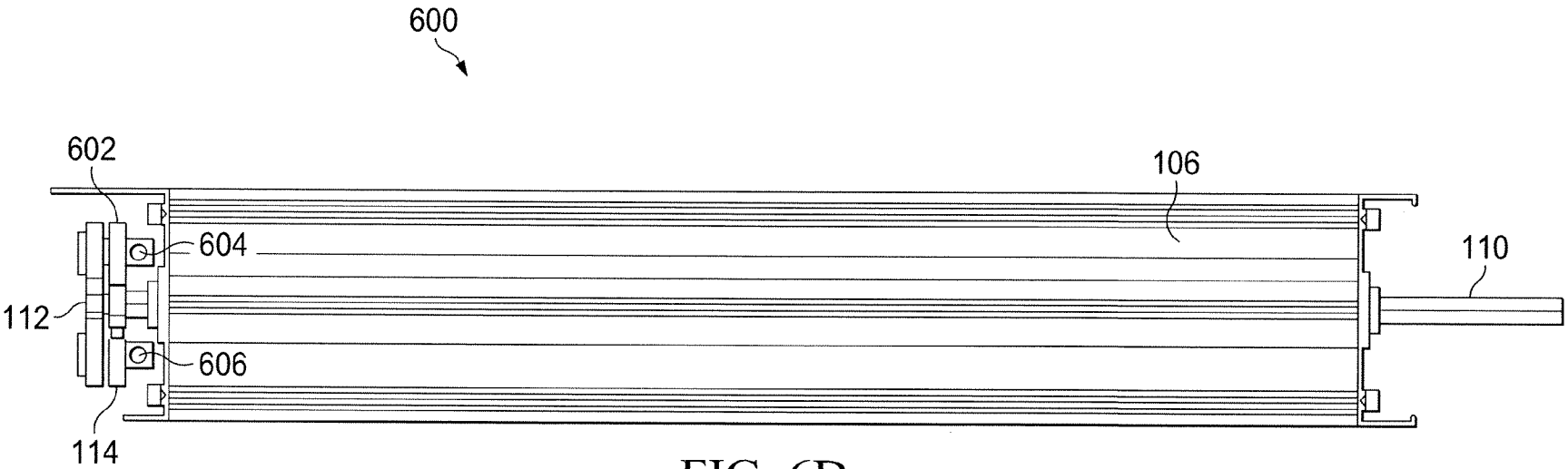
FIG. 6D is a top view of air control damper in accordance with an exemplary embodiment of the present disclosure.

FIG. 6D is a top view of air control damper 600 in accordance with an exemplary embodiment of the present disclosure. Rod 604 is coupled to rockers 602, and rod 606 is coupled to rockers 114 and cross-over link 112.

Figure 6E:
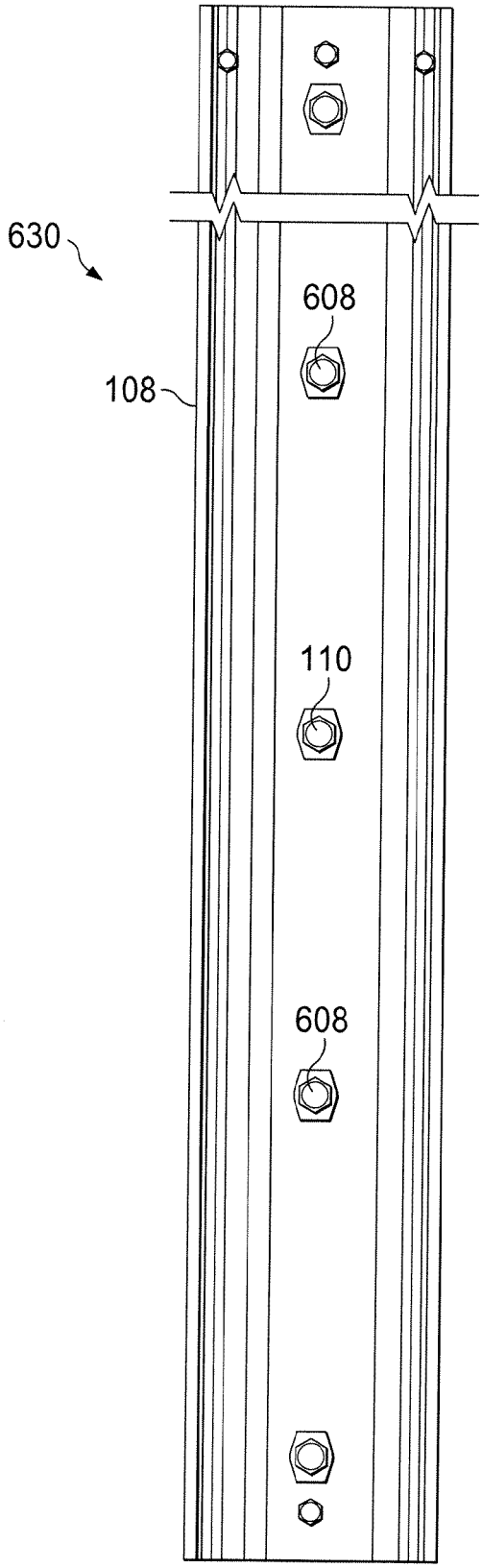
FIG. 6E is a diagram of idle frame side in accordance with an exemplary embodiment of the present disclosure.

FIG. 6E is a diagram of idle frame side 630 in accordance with an exemplary embodiment of the present disclosure. Axel 110 and shafts 608 can rotate freely in frame side 108.

Figure 7:
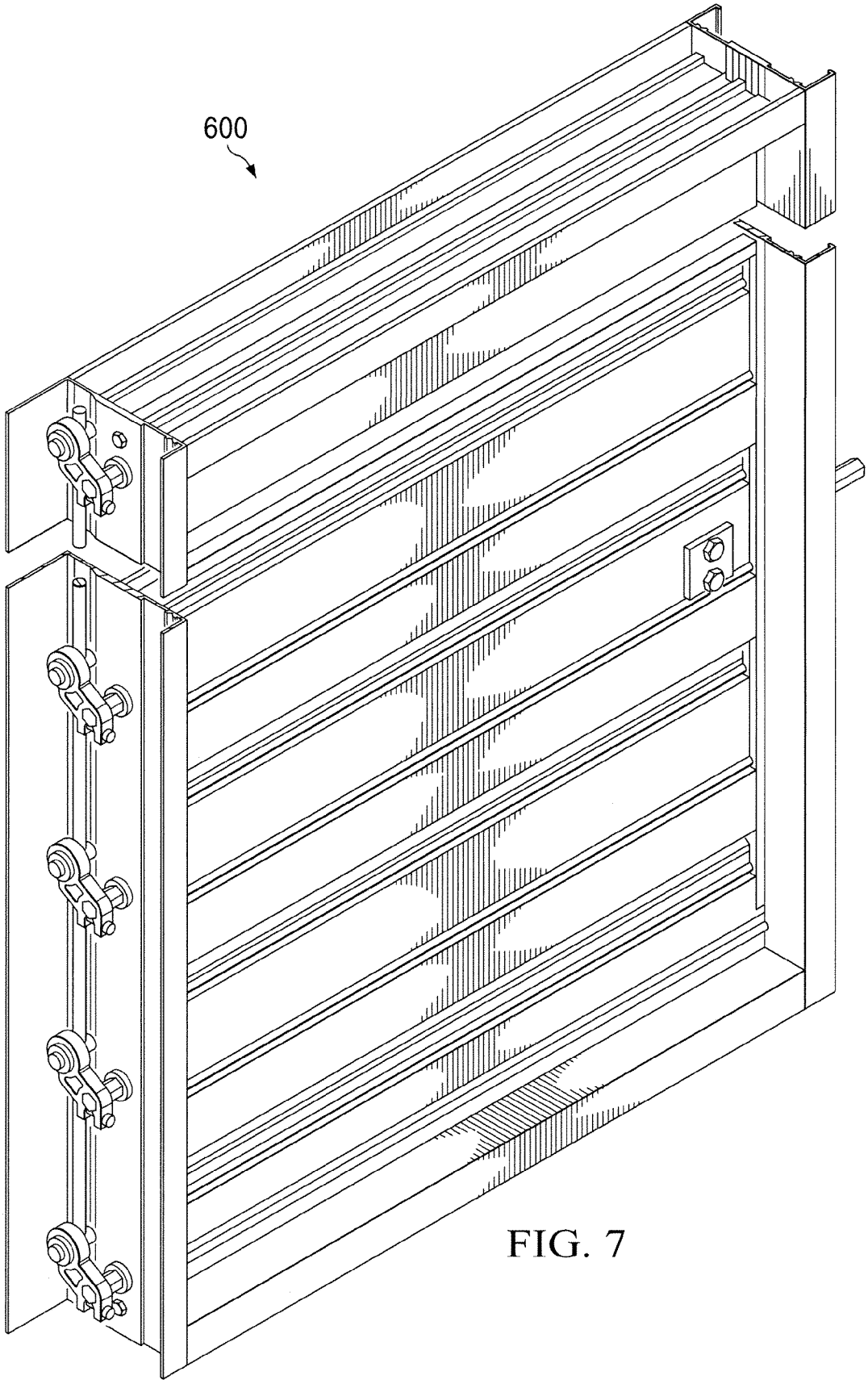
FIG. 7 is a perspective view of multi-blade air control damper in accordance with an exemplary embodiment of the present disclosure.

FIG. 7 is a perspective view of multi-blade air control damper 600 in accordance with an exemplary embodiment of the present disclosure.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. An air control damper, comprising:

an axle coupled to a frame;

a first full width blade coupled to the axle and disposed within the frame, wherein the first full width blade further comprises a plurality of protrusions, each configured to hold a foam material disposed within the first full width blade;

a rocker assembly coupled to the first full width blade;

a first rod coupled to the first rocker assembly;

a first cross-link assembly coupled to the first rod; and a half width blade coupled to the first cross-link assembly and disposed on a first shaft within the frame, wherein the half width blade is configured to provide a blade stop for the first full width blade in a closed position.

2. The air control damper of claim 1 further comprising a second rod coupled to the rocker assembly.

3. The air control damper of claim 2 further comprising a second cross-link assembly coupled to the second rod.

4. The air control damper of claim 3 further comprising a second full width blade coupled to the second cross-link assembly and disposed on a second shaft within the frame.

5. The air control damper of claim 1 wherein the first full width blade further comprises a plurality of slots, each configured to hold a seal.

6. The air control damper of claim 1 wherein the half width blade further comprises a slot configured to hold a seal.

7. The air control damper of claim 1 wherein the half width blade further comprises a plurality of protrusions, each configured to hold a foam material disposed within the half width blade.

8. The air control damper of claim 1 wherein the frame further comprises a plurality of slots, each configured to hold a seal.

9. A method of manufacturing an air control damper that has a shaft coupled to a frame, a first full width blade coupled to the axle and disposed within the frame, a rocker assembly coupled to the first full width blade, a first rod coupled to the rocker assembly, a first cross-link assembly coupled to the first rod, a half width blade coupled to the first cross-link assembly and disposed on a first shaft within the frame, wherein the half width blade is configured to provide a blade stop for the first full width blade in a closed position, a second rod coupled to the rocker assembly, a second cross-link assembly coupled to the second rod, a second full width blade coupled to the second cross-link assembly and disposed on a second shaft within the frame, wherein the first full width blade further comprises a plurality of slots, each configured to hold a seal, wherein the first full width blade further comprises a plurality of protrusions, each configured to hold a foam material disposed within the first full width blade, wherein the half width blade further comprises a slot configured to hold a seal, wherein the half width blade further comprises a plurality of protrusions, each configured to hold a foam material disposed within the half width blade, and wherein the frame further comprises a plurality of slots, each configured to hold a seal, the method comprising:

coupling an axle to a frame;

coupling a first full width blade to the axle and disposing the first full width blade within the frame;

coupling a rocker assembly to the first full width blade;

coupling a first rod to the rocker assembly;

coupling a first cross-link assembly to the first rod;

coupling a half width blade to the first cross-link assembly and disposing the half width blade on a first shaft within the frame;

coupling a second rod to the rocker assembly;

coupling a second cross-link assembly to the second rod;

coupling a second full width blade to the second cross-link assembly and disposing the second full width blade on a second shaft within the frame;

forming a plurality of slots in the first full width blade, each configured to hold a seal;

forming a plurality of protrusions in the first full width blade, each configured to hold a foam material disposed within the first full width blade;

forming a slot in the half width blade further to hold a seal;

forming a plurality of protrusions in the half width blade to hold a foam material disposed within the half width blade; and forming a plurality of slots in the frame, each configured to hold a seal, wherein the half width blade is configured to provide a blade stop for the first full width blade in a closed position, and wherein the steps can be performed in any suitable order.

10. A method of manufacturing an air control damper, comprising:

coupling an axle to a frame;

forming a plurality of protrusions in a first full width blade, each configured to hold a foam material disposed within the first full width blade;

coupling the first full width blade to the axle and disposing the first full width blade within the frame;

coupling a rocker assembly to the first full width blade;

coupling a first rod to the rocker assembly;

coupling a first cross-link assembly to the first rod; and coupling a half width blade to the first cross-link assembly and disposing the half width blade on a first shaft within the frame, wherein the half width blade is configured to provide a blade stop for the first full width blade in a closed position, and wherein the steps can be performed in any suitable order.

11. The method of claim 10 further comprising coupling a second rod to the rocker assembly.

12. The method of claim 11 further comprising coupling a second cross-link assembly to the second rod.

13. The method of claim 12 further comprising coupling a second full width blade to the second cross-link assembly and disposing the second full width blade on a second shaft within the frame.

14. The method of claim 10 further comprising forming a plurality of slots in the first full width blade, each configured to hold a seal.

15. The method of claim 10 further comprising forming a slot in the half width blade further to hold a seal.

16. The method of claim 10 further comprising forming a plurality of protrusions in the half width blade to hold a foam material disposed within the half width blade.

17. The method of claim 10 further comprising forming a plurality of slots in the frame, each configured to hold a seal.

18. An air control damper, comprising:

an axle coupled to a frame;

a first full width blade coupled to the axle and disposed within the frame;

a rocker assembly coupled to the first full width blade;

a first rod coupled to the first rocker assembly;

a first cross-link assembly coupled to the first rod; and a half width blade coupled to the first cross-link assembly and disposed on a first shaft within the frame, wherein the half width blade is configured to provide a blade stop for the first full width blade in a closed position, wherein the half width blade further comprises a plurality of protrusions, each configured to hold a foam material disposed within the half width blade.

19. A method of manufacturing an air control damper, comprising:

coupling an axle to a frame;

coupling a first full width blade to the axle and disposing the first full width blade within the frame;

coupling a rocker assembly to the first full width blade;

coupling a first rod to the rocker assembly;

coupling a first cross-link assembly to the first rod;

forming a plurality of protrusions in a half width blade to hold a foam material disposed within the half width blade; and coupling the half width blade to the first cross-link assembly and disposing the half width blade on a first shaft within the frame, wherein the half width blade is configured to provide a blade stop for the first full width blade in a closed position, and wherein the steps can be performed in any suitable order.

* * * * *